US005713745A

United States Patent [19]

Sakurai et al.

[11] Patent Number: 5,713,745

[45] Date of Patent: Feb. 3, 1998

[54] CONNECTOR FOR WIRING BOARD

[75] Inventors: Toshikazu Sakurai; Atsushi Sakatani, both of Yokkaichi, Japan

[73] Assignee: Sumitomo Wiring Systems, Ltd.

[21] Appl. No.: 588,720

[22] Filed: Jan. 19, 1996

[30] Foreign Application Priority Data

Jan. 20, 1995 [JP] Japan ..... 7-026007

[51] Int. Cl.[6] ..... H01R 9/09

[52] U.S. Cl. ..... 439/78; 439/752

[58] Field of Search ..... 439/892.1, 78, 439/83, 81, 82, 70, 525, 892, 378, 686, 695, 701, 79

[56] References Cited

U.S. PATENT DOCUMENTS 4,986,772 1/1991 Fukutani ..... 439/79

5,299,959 4/1994 Yamamoto et al. ..... 439/752

5,533,901 7/1996 Hunt et al. ..... 439/79

FOREIGN PATENT DOCUMENTS 60-181867 3/1985 Japan .

*Primary Examiner*—Neil Abrams

*Assistant Examiner*—Christopher Goins

*Attorney, Agent, or Firm*—Banner & Witcoff, Ltd.

[57] ABSTRACT

An improved plate connector avoids misalignment during attachment to a plate. During attachment of a retainer 30 to a housing 10, a plate attachment member 23A is guided by a guiding face 37A and is inserted into a position fixing hole 36A. Misalignment of the plate attachment member 23A after assembly with the retainer 30 is avoided. The plate attachment member 23A fits into an attachment hole H of a plate P smoothly, and damage to the plate attachment member 23A is prevented.

16 Claims, 7 Drawing Sheets

CONNECTOR FOR WIRING BOARD

TECHNICAL FIELD

The present invention relates to an electrical plate connector for attachment to a plate.

BACKGROUND OF THE INVENTION

FIG. 11 of the appended drawings shows a prior art type of plate connector 50. The plate connector has a configuration whereby a housing 51 has a cavity 52 into which a female terminal fitting 53 is inserted from the bottom as viewed. The female terminal fitting 53 is engaged by a resilient lance 57 which retains it. A projecting member 54 comprising the female socket is aligned with a hole 58 provided on an upper face of the housing 51. The female terminal fitting 53 has a resilient member 55 bent into a V-shape, and a plate attachment member 56 projecting beyond the elastic bent member 55 in a downward direction.

The housing 51 is positioned on a plate P by a position fixing means (not shown). In addition, the plate attachment member 56 is fixed to the plate P by insertion through an attachment hole H, and then soldering (not shown), thus the plate P and fitting 53 are electrically connected.

In the prior art plate connector 50, the attachment direction of the plate attachment member 56 and the projection direction of the projecting member 54 are the same, and a resilient member 55 is provided therebetween to accommodate end loadings due to catching of the member 54 on the hole H. Furthermore, the resilient member 55 can accommodate movement due to attachment resistance of the corresponding male terminal fitting through the aperture 58. In such cases, the resilient member 55 bends and thereby serves to prevent excess stress from being applied to the plate attachment member 56, and to prevent the plate attachment member 56 from being damaged, and so on.

In the case of the prior plate connector 50 it is difficult to make the elastic bent member 55 conform to a specified bent shape with a high degree of accuracy. Consequently, there is a possibility of the plate attachment member 56 not sitting in the correct position with respect to the projecting member 54, and of not being aligned properly with the hole H on assembly. Moreover, even if no misalignment of the plate attachment member 56 occurs at the manufacturing stage of the terminal fitting 53, misalignment of the plate attachment member 56 may occur during the attachment of the housing 51 or during handling after attachment.

In the case where such a misalignment occurs, the plate attachment member 56 may collide with the plate P instead of entering the hole H smoothly, resulting in problems such as difficulty during the attachment operation, damage to the plate attachment member 56, etc. This problem is increased if a plate connector has many such attachment members.

SUMMARY OF THE INVENTION

The present invention has been developed after taking into consideration the problems discussed above and aims at preventing misalignment of such plate attachment members.

According to the invention there is provided a plate connector comprising a housing with a cavity formed therein, and a terminal fitting in the cavity, said fitting comprising a plate attachment member projecting from the housing and adapted for attachment to a plate, and a resilient member inwardly of the plate attachment member;

the plate connector further comprising a retainer attachable to a face of the housing from which said plate attachment member projects, the retainer having a position fixing hole formed therein for receiving and correcting the position of the plate attachment member as the retainer is attached to the housing in use.

Misalignment of the plate attachment member during the manufacturing process of the terminal fitting or during attachment of the terminal fitting into the cavity, is corrected as the retainer is attached to the housing. The position fixing hole holds the attachment member against movement. Moreover, the plate attachment member is protected from misalignment if an external force is applied to the plate attachment member during handling thereof. Furthermore, excessive force cannot be applied to the terminal fitting since the resilient member absorbs end loads on the attachment member.

In the preferred embodiment a tapered guide face is formed in the retainer, the guiding face guiding the plate attachment member into the position fixing hole as the retainer and the housing are assembled.

The guiding face ensures that a misaligned plate attachment member enters the position fixing hole without colliding with the retainer.

Preferably the guide face is circular about said hole, and in the preferred embodiment the guide face is constituted by the position fixing hole. Preferably the position fixing hole includes a parallel sided bore outboard of the guide face, the bore fitting closely around the attachment member and thus providing support therefor.

A pushing member of the retainer may be provided to push the terminal fitting into said cavity during assembly of the retainer to the housing.

The pushing member ensures that a partly inserted terminal fitting is fully inserted into the cavity as the retainer is attached to the housing.

Preferably the terminal fitting includes opposite shoulders for abutment with opposite pushing faces of the retainer. The pushing faces both ensure full insertion of the terminal fitting and retain the fitting in the cavity.

Consequently, unlike the case where the terminal fitting is held in place by means of an elastic stopping member (such as a lance) formed inside the cavity, deformation or misalignment of the plate attachment member and incorrect insertion of the terminal fitting can be prevented. This deformation or misalignment of the plate attachment member occurs due to frictional resistance with the elastic stopping member (lance) when the plate attachment member is gripped for inserting the terminal fitting into the cavity, and incorrect insertion of the terminal fitting occurs due to a misconception that the partly inserted terminal fitting has been inserted correctly, the misconception resulting from the terminal fitting becoming hard to remove due to the frictional force between the half-inserted terminal fitting and the elastic stopping member.

Furthermore, since it is no longer necessary to provide a member such as the elastic stopping member inside the cavity in order to hold the terminal fitting, the moulding of the interior of the cavity can be simplified, resulting in lower production costs.

The terminal fitting preferably includes a protrusion at one side thereof for engagement in a corresponding recess of the cavity. Such a protrusion ensures that the terminal fitting can be fitted in one orientation only, and prevents arcuate movement thereof relative to the cavity.

In the preferred embodiment the terminal fitting is one piece and comprises a plate attachment member at one end, a connector portion at the other end and adapted to receive an electrical connector, and a mid portion comprising said resilient member. The resilient member is preferably of serpentine form and includes one or more undulations to absorb end loads on the attachment member and to accommodate re-alignment thereof as the retainer is attached to the housing.

The resilient member may extend at one side of the housing, and the connector is preferably folded from a sheet metal blank.

The connector assembly according to the invention may include a plurality of said cavities each having a connector with a protruding attachment member. A single retainer is preferably provided to push partly inserted connectors fully into the corresponding recess, to guide respective attachment members into the correctly aligned condition, and to retain the connectors in the housing. The retainer is preferably removably attached by e.g. co-operating resilient latch members which may provide an intermediate and final attachment condition. In a preferred embodiment the intermediate condition ensures that the plate attachment member is protected from damage during transit. The attachment force in the intermediate condition is preferably lower than in the final condition.

BRIEF DESCRIPTION OF THE DRAWINGS

Other features of the invention will be apparent from the following description of preferred embodiments described by way of example only with reference to the accompanying drawings in which.

An embodiment of the present invention is explained hereinbelow, with reference to FIGS. 1 to 9.

A plate connector 1 of the present embodiment comprises a housing 10, terminal fittings 20A, 20B, and a retainer 30.

DETAILED DESCRIPTION OF THE PREFERRED EMBODIMENTS

Figure 1:
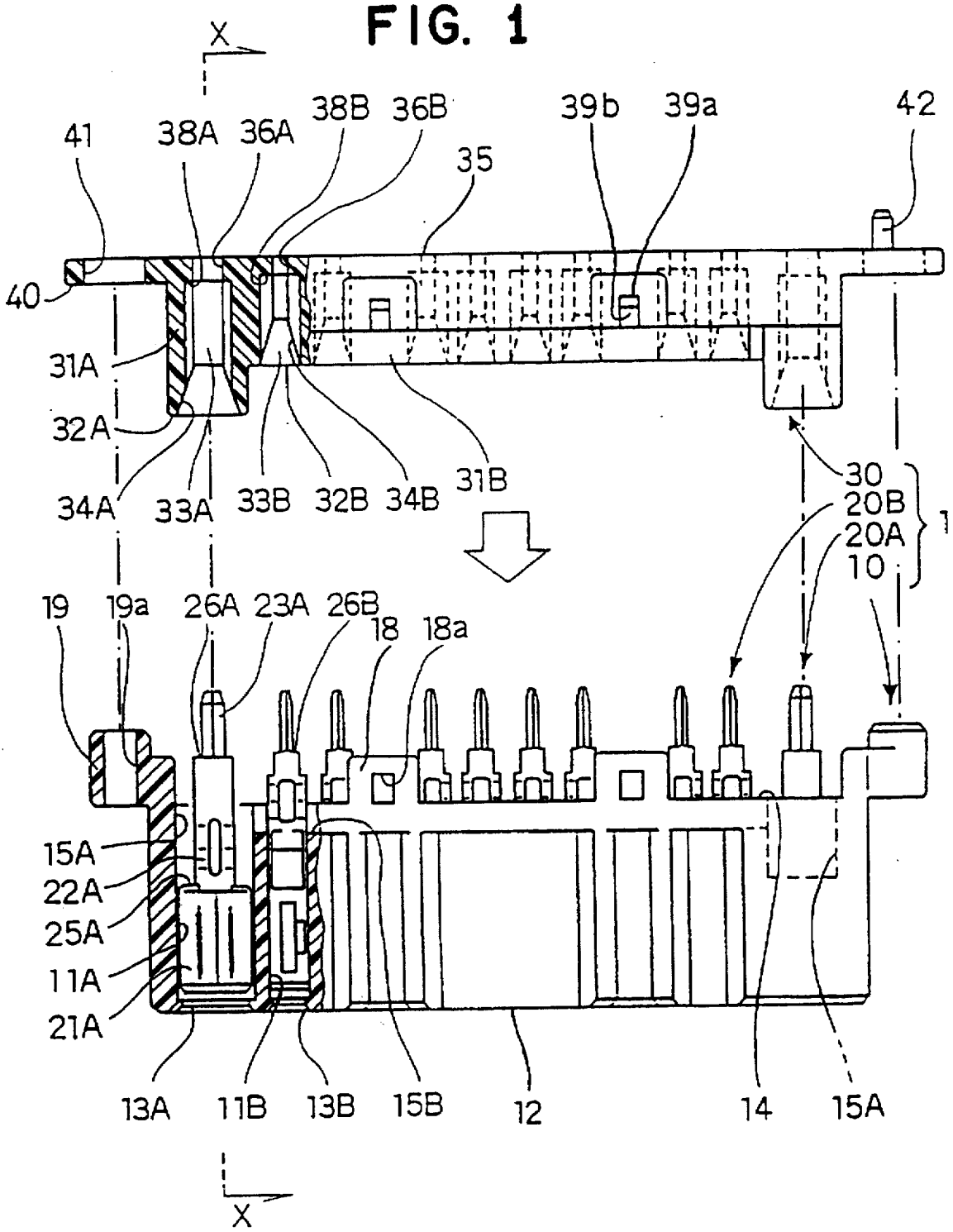
FIG. 1 is a partly cut-away sectional view showing the separated state of a housing and a retainer of a plate connector according to an embodiment of the present invention.

The housing 10 is made of synthetic resin material. As shown in FIG. 1, at the left and right extremities of the housing 10, cavities 11A are formed for insertion of large terminal fittings 20A. Between these cavities 11A, a plurality of cavities 11B are formed for insertion of small terminal fittings 20B. Insertion holes 13A, 13B connected to the cavities 11A, 11B respectively, are formed on an insertion face 12 (the lower face in FIG. 1) of the housing 10, into which corresponding male connectors (not shown) are inserted to engage the respective fittings 20A, 20B. Located opposite to the insertion face 12 is an attachment face 14 against which the retainer 30, is engaged. The cavities 11A, 11B open to the attachment face 14 through respective openings 15A, 15B, 15A.

Tapered guide faces 16A, 16B (FIG. 4) are formed at the mouths of the openings 15A, 15B and facilitate insertion of terminal fittings 20A, 20B. The cavities 11A, 11B have a generally rectangular section and a respective internal wall face thereof has an insertion groove 17A, 17B formed therein in order to accommodate projecting ends 24A, 24B of the terminal fittings 20A, 20B.

A plurality of resilient, plate-shaped fitting members 18 project from the attachment face 14 of the housing 10, and have fitting holes 18*a* formed therein. The housing 10 and the retainer 30 are held together after attachment by fitting protrusions 39*a* provided on the retainer 30 which engage the fitting holes 18*a* in a snap fitting manner. The housing 10 and the retainer 30 are separable since the resilient fitting members 18 can be bent outwards to release the fitting protrusions 39*a* from the fitting holes 18*a*.

Hubs 19 are formed on both the extreme ends of the housing 10. During attachment of the retainer 30 the hubs 19 fit into corresponding hub holes 41. Machine screws (not shown) for fixing the plate can pass through the hubs and the hubs 19 may have threads 19*a* for engagement with threads (not shown) of a plate P.

Figure 6:
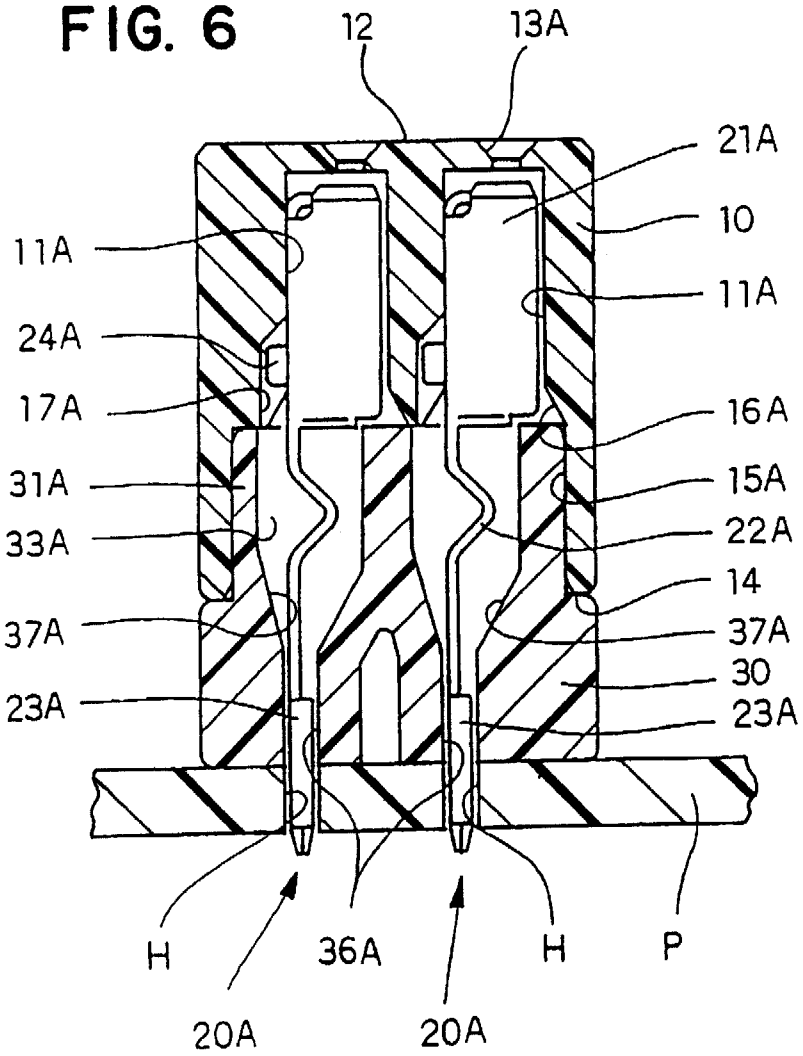
FIG. 6 is an enlarged cross-section view showing the plate connector attached to a plate.
Figure 8A:
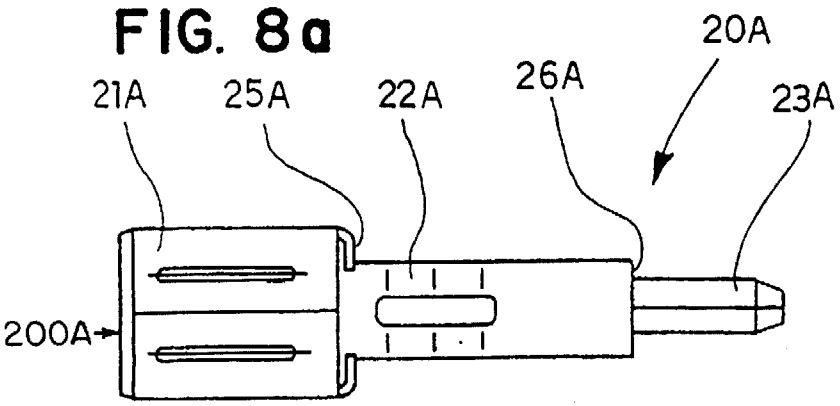
FIG. 8*a* is a front elevation of a large terminal fitting.
Figure 8B:
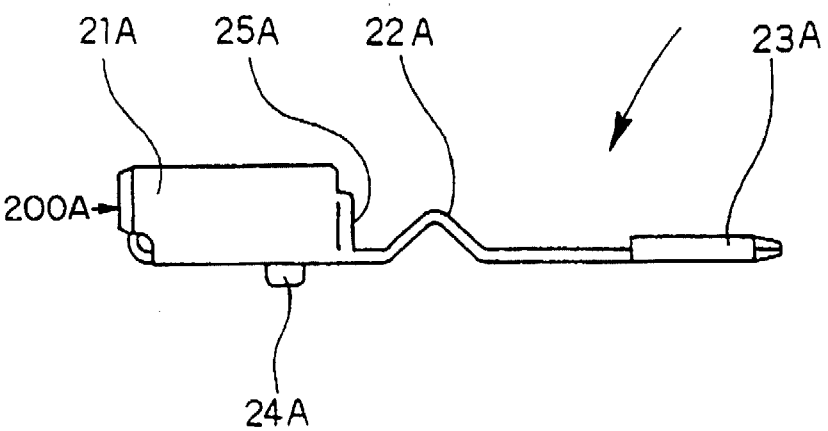
FIG. 8*b* is a side elevation of the large terminal fitting.

As shown in FIGS. 8*a* and 8*b*, the large terminal fitting 20A comprises an insertion member 21A, a resilient bent member 22A, and a plate attachment member 23A. The insertion member 21A is insertable into the cavity 11A and has a rectangular section. Its free end face has an opening 200A that aligns with the insertion hole 13A. A corresponding male terminal fitting (not shown) can be inserted through the hole 13A into the opening 200A. A face 25A is provided on the insertion member 21A opposite to the opening 200A. The face 25A is contacted by a pushing face 32A of the retainer 30 in use. One side face of the insertion member 21A has a plate-shaped projection 24A formed by partially cutting out a portion from the side face and bending it outwards. This projection 24A is insertable into the insertion groove 17A of the cavity 11A. The resilient member 22A extends along the longitudinal direction of the opening 200A and is connected to the side of the insertion member 21A on which the projection 24A is formed. The centre of the extended portion of the resilient member 22A is formed in a V-shape. Due to the resilience of this V-shaped portion, excess force on other parts of the terminal fitting 20A is prevented, as will be further explained. The plate attachment member 23A is formed by folding the sides of an extension of the resilient portion in towards the centre. The plate attachment member 23A is arranged to be insertable into an attachment hole H formed in a plate P (FIG. 6).

Figure 9A:
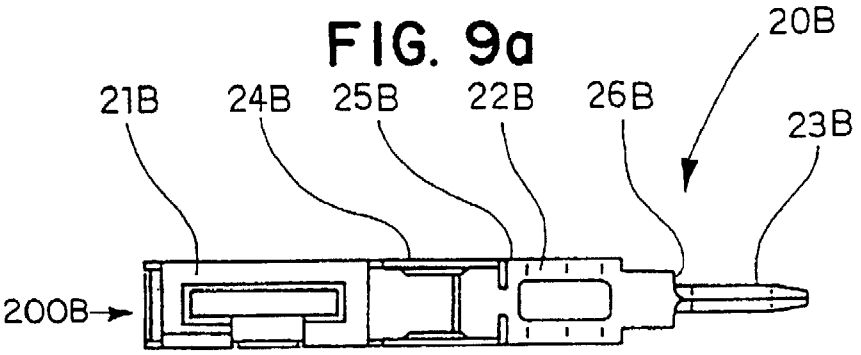
FIG. 9*a* is a front elevation of a small terminal fitting.
Figure 9B:
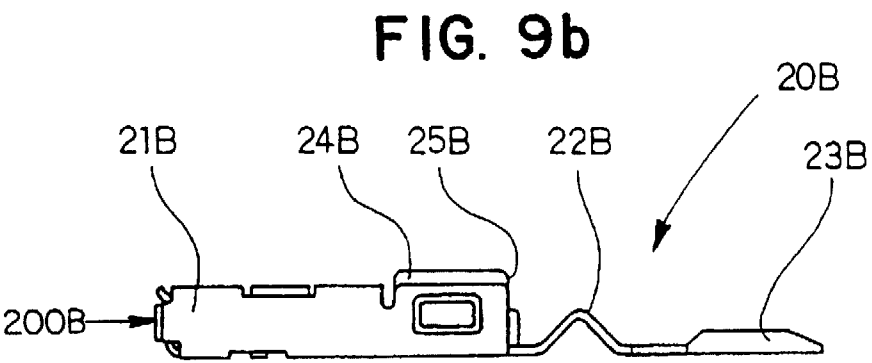
FIG. 9*b* is a side elevation of the small terminal fitting.

As shown in FIGS. 9*a* and 9*b*, the small terminal fitting 20B comprises an insertion member 21B, a resilient bent member 22B and a plate attachment member 23B. The insertion member 21B is insertable into the cavity 11B and has a rectangular section. One end face has an opening 200B that aligns with the insertion hole 13B. A corresponding male terminal fitting (not shown) can be inserted into the opening 200B. One side face of the insertion member 21B has a plate-shaped projection 24B formed by partially cutting out a portion from the side face and bending it outwards. This projection 24B is insertable into the insertion groove 17B of the cavity 11B. A face 25B is provided opposite the opening 200B for contact with a pushing face 32B of the retainer 30. The resilient bent member 22B is formed into a V-shape, and due to the elasticity of this V-shaped portion, application of excess force on other parts of the terminal fitting 20B is prevented.

The retainer 30 is shaped so as to fit with the attachment face 14 of the housing 10. Attachment members 31A, 31B are formed on the retainer 30 on a face corresponding to the attachment face 14. The attachment members 31A, 31B are insertable into the openings 15A, 15B, and the projecting end faces thereof form pushing faces 32A, 32B. In the case where the terminal fittings 20A, 20B are inserted correctly into the cavities 11A, 11B, the pushing faces 32A, 32B lightly make contact with the faces 25A, 25B when the retainer 30 is attached to the housing 10. In the case where the terminal fittings 20A, 20B are not in a fully inserted condition, the pushing faces 32A, 32B contact the faces 25A, 25B as the retainer 30 is attached, thereby moving the terminal fittings 20A, 20B into a fully inserted condition.

A plurality of insertion chambers 33A, 33B are formed into the retainer 30. The insertion chambers 33A, 33B open out in the direction of the pushing faces 32A, 32B and align with the cavities 11A, 11B. Tapered guide faces 34A, 34B are formed at the mouths of each of the insertion chambers 33A, 33B so as to align with the mouths of the cavities 11A, 11B. These guide faces 34A, 34B allow the plate attachment members 23A, 23B and the resilient members 22A, 22B to smoothly enter the insertion chambers 33A, 33B with certainty and without the possibility of getting stuck. Further, when the retainer 30 is attached to the housing 10, it is arranged that there is enough space in the insertion chambers 33A, 33B to permit the resilient members 22A, 22B to move.

In the chambers 33A, 33B, position fixing through holes 36A, 36B are formed which open out to an attachment face 35 which is opposite to the pushing faces 32A, 32B, that is, on the side where the plate P makes contact. The cross-sectional area of each of the position fixing holes 36A, 36B is smaller than that of each of the insertion chambers 33A, 33B through which the plate attachment members 23A, 23B can pass without the likelihood of any sticking. The position fixing holes 36A, 36B are arranged in such a position as to be aligned with respect to the attachment holes H of a plate P (FIG. 6). The plate-attachment members 23A, 23B are arranged to have no play in the direction of the surface of the attachment face 35, but to be movable in a direction that is longitudinal with respect to the position fixing holes 36A, 36B.

Guiding faces 37A, 37B are formed in the insertion chambers 33A, 33B in such a way as to make the inner walls of the insertion chambers 33A, 33B increasingly narrow in the direction of the position fixing holes 36A, 36B. These guiding faces 37A, 37B face towards the plate face of the resilient members 22A, 22B. In the case where the resilient members 22A, 22B change shape abnormally resulting in misalignment of the position of the plate attachment members 23A, 23B, the guiding faces 37A, 37B serve to correct the misalignment by guiding the plate-attachment members 23A, 23B into the position fixing holes 36A, 36B.

Figure 2:
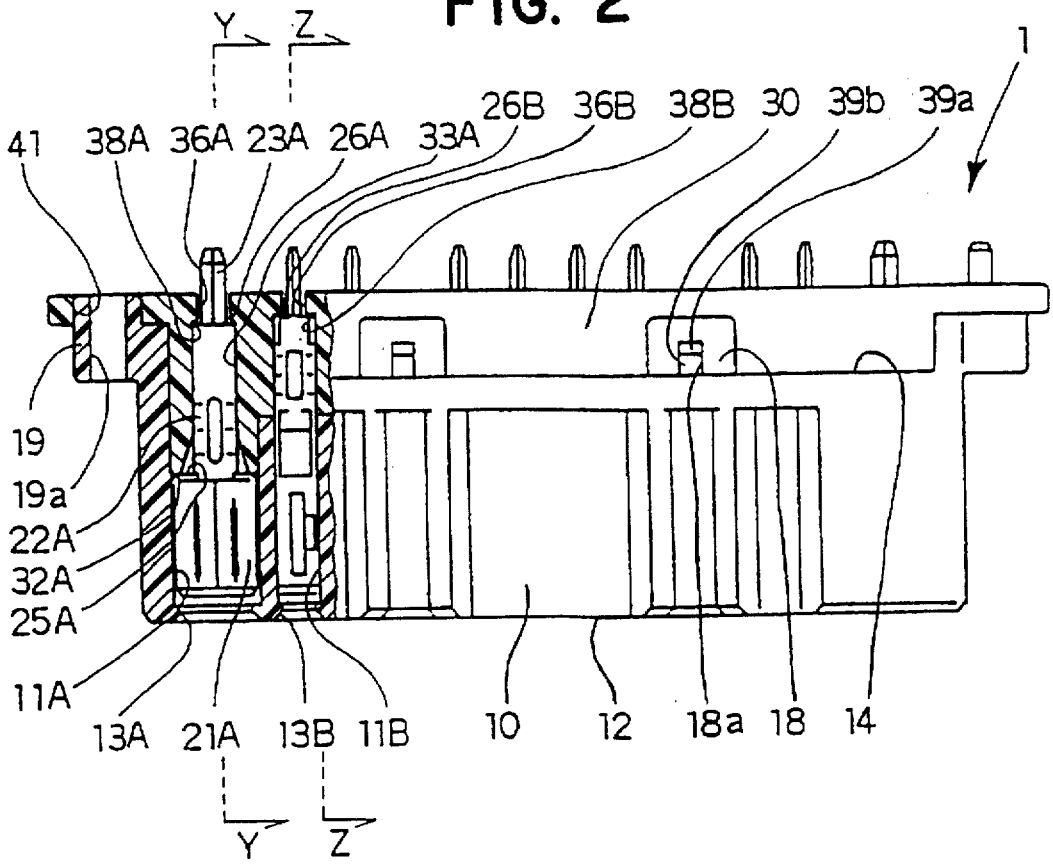
FIG. 2 is a partly cut-away front view showing the assembled housing and retainer.

Abutments 38A, 38B are located near the position fixing holes 36A, 36B on that inner wall of the insertion chambers 33A, 33B which does not have the guiding faces 37A, 37B formed thereon. These abutments 38A, 38B make contact with shoulders 26A, 26B, each located at the projecting end of each of the resilient members 22A, 22B. The shoulders engage the abutments 38A, 38B, thereby preventing the resilient members 22A, 22B from moving outwardly (FIG. 2).

Fitting protrusions **39*a* are formed on both sides of the retainer 30 and have angled guide faces 39*b* in order to facilitate engagement with the holes 18*a*. Hub holes 41 are formed on both ends of a plate-shaped member 40 for engagement with the hubs 19. The two ends of the plate-shaped base 40 also have position fixing pins 42** projecting therefrom and for engagement with position fixing guide holes (not shown) of the plate P.

The operation of the present embodiment is now explained. First the housing 10 is placed so that its attachment face 14 is upward. Then, the terminal fittings 20A, 20B are dropped into the cavities 11A, 11B under gravitational force (FIG. 1). If projections 24A, 24B are not aligned with the insertion grooves 17A, 17B, the terminal fittings 20A, 20B cannot be fully inserted because the projections 24A, 24B engage the open ends of the cavities 11A, 11B. Erroneous insertion of the terminal fittings 20A, 20B is thereby prevented.

When the terminal fittings 20A, 20B are correctly inserted into the cavities 11A, 11B, the retainer 30 is attached to the housing 10. During attachment, the tapered guide face **39*b* of the fitting protrusions 39*a* resiliently bend the fitting members 18 of the housing 10 outwards and once the retainer 30 is fully inserted, the protrusions 39*a* engage the fitting holes 18*a* to firmly lock the housing 10 in place. Furthermore, the hub 19 of the housing 10 enters the hub hole 41 of the retainer 30**.

Figure 3:
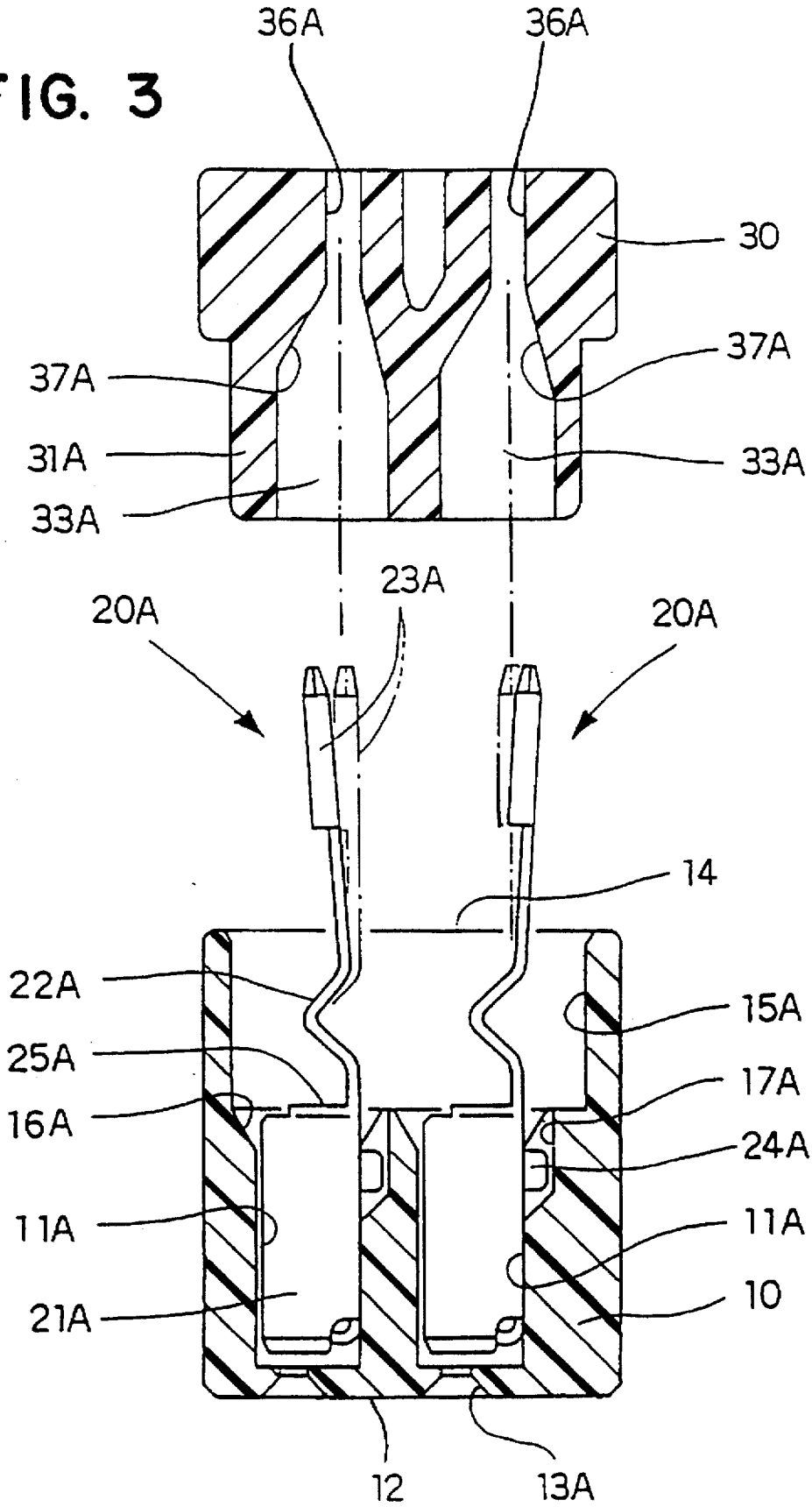
FIG. 3 is an enlarged cross-section view along the lines X—X of FIG. 1.
Figure 5:
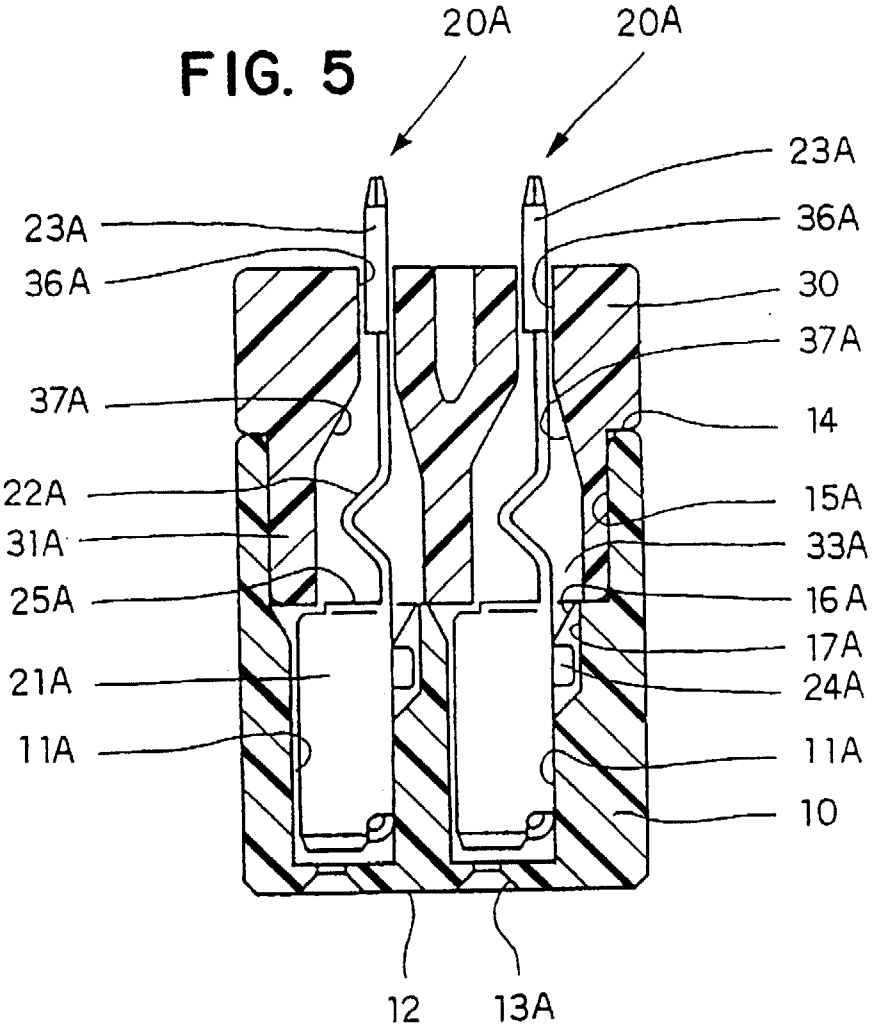
FIG. 5 is an enlarged cross-section view along the lines Y—Y of FIG. 2.

As the retainer 30 is attached to the housing 10, the attachment members 31A, 31B enter the openings 15A, 15B. At the same time, the plate attachment members 23A, 24B enter the insertion chambers 33A, 33B as do the resilient members 22A, 22B. As shown in FIGS. 3 and 5, when attachment is complete, the plate attachment members 23A, 23B pass through the position fixing holes 36A, 36B and project outwards to a specified distance from the attachment face 35. The resilient members 22A, 22B remain inside the insertion chambers 33A, 33B. The pushing faces 32A, 32B either make light contact with the faces 25A, 25B of the terminal fittings 20A, 20B or face them at a close proximity.

Figure 4:
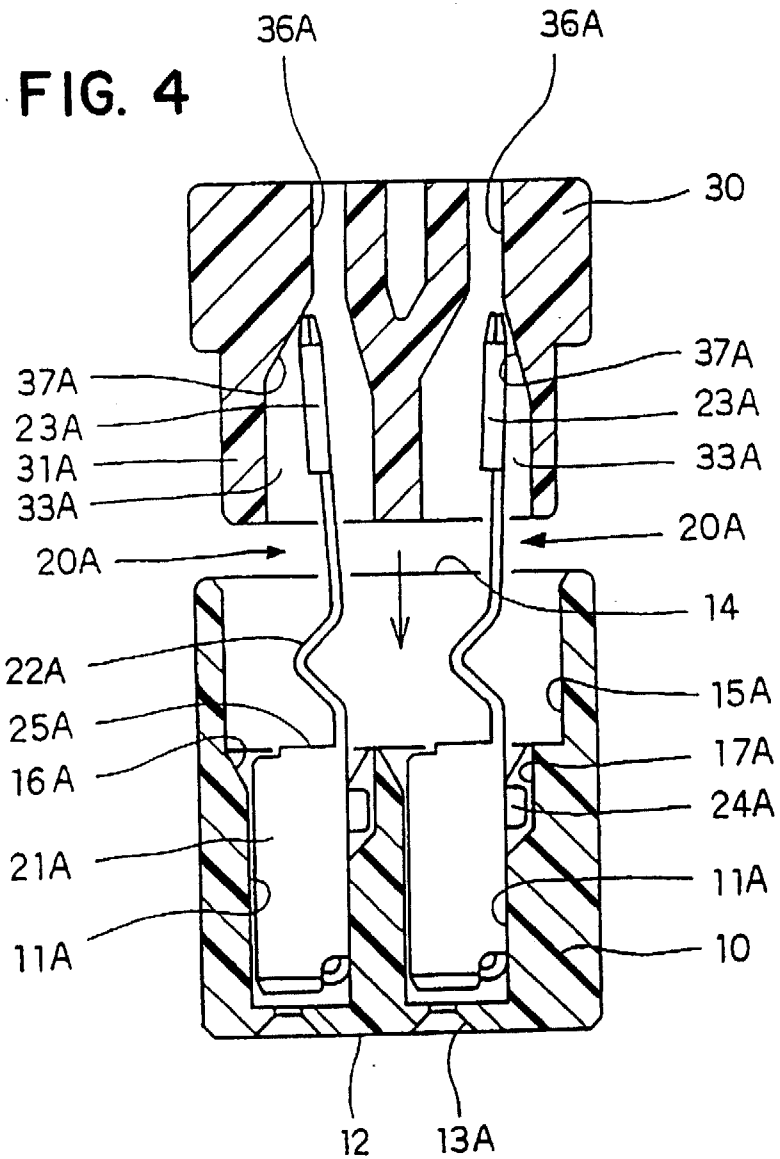
FIG. 4 is an enlarged cross-section view showing an intermediate stage in the assembly process of the retainer and the housing.
Figure 7:
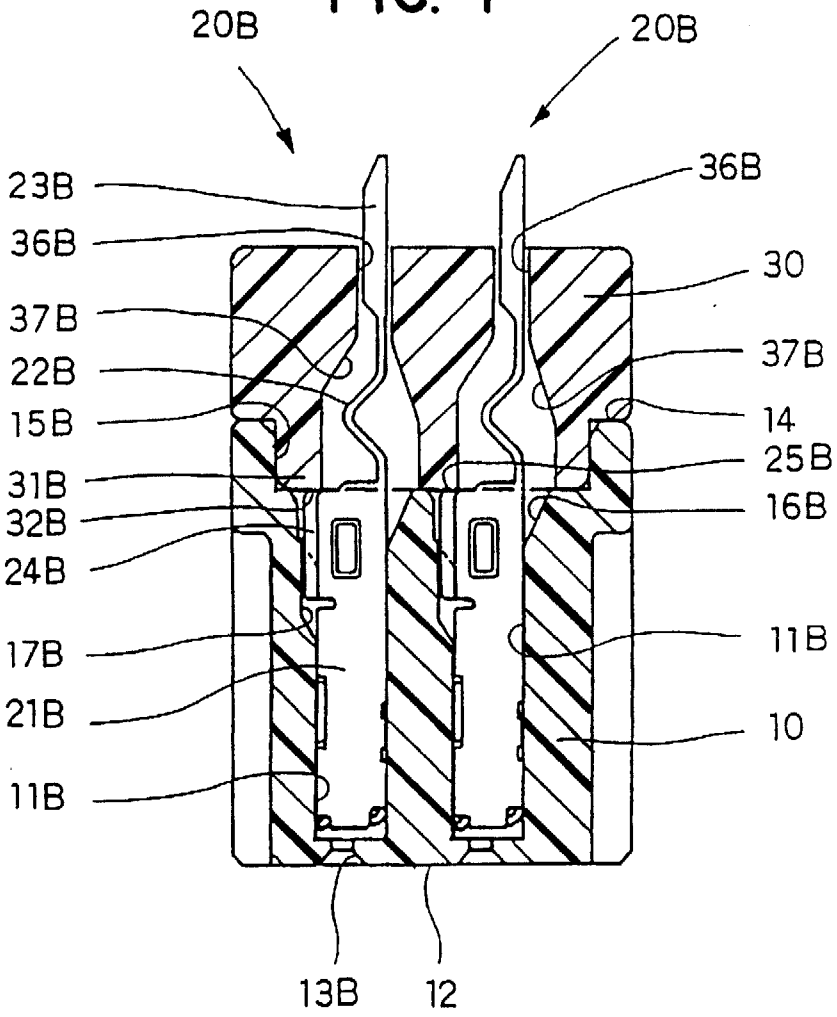
FIG. 7 is an enlarged cross-section view along the lines Z—Z of FIG. 2.

Regarding the attachment process of the retainer 10, the plate attachment members 23A are guided into the position fixing holes 36A even if, as shown in FIG. 3 by bold lines, the plate attachment members 23A are misaligned due to reasons such as the shape of the resilient members 22A being distorted during the manufacturing process of the large terminal fittings 20A, or due to contact with other parts. This is because the plate attachment members 23A make contact with and are guided by the guiding faces 37A of the retainer 30, as shown in FIG. 4. Consequently, the attachment operation of the retainer 30 can be carried out smoothly, and damage to or distortion in shape of the plate attachment member 23A, due to collision with the inner walls of the insertion chambers 33A, is avoided. Similarly, in the case of the small terminal fitting 20B, even if the plate attachment members 23B are misaligned the plate attachment members 23B are inserted smoothly into the position fixing holes 36B by the guiding faces 37B.

Similarly, during the attachment process of the retainer 30, even if, due to e.g. sticking, the terminal fittings 20A, 20B are not inserted sufficiently deeply into the cavities 11A, 11B, the pushing faces 32A, 32B of the retainer 30 make contact with the faces 25A, 25B which are pushed inwards. Thus, even if the terminal fittings 20A, 20B are in a half-inserted position, they are forced into the fully inserted condition by the retainer 30. As a result, there is no risk that the terminal fittings 20A, 20B may be left in a half-inserted position.

When the plate connector 1 is in an attached condition as described above, the plate attachment members 23A, 23B projecting from the retainer 30 are fixed in the correct position since they pass through the position fixing holes 36A, 36B. Further, even if an external force is applied on the plate attachment members 23A, 23B from the sides, their position will remain stable because they are supported at the extremity of the retainer. Moreover, if an external end force is applied in the longitudinal direction, the resilient members 22A, 22B will bend, and damage to the plate attachment members 23A, 23B due to application of excess force is thereby avoided.

When the plate connector 1 is to be attached to a plate P, the connector 1 is turned so that the plate attachment members 23A, 23B face the plate P. The position of the plate connector 1 is then fixed with respect to the plate P by making the position fixing pin 42 enter guide holes (not shown) in the plate P, and by making the screwed holes 19*a* align with screw holes (not shown) in the plate P through which screws (not shown) may be passed. In this way, the plate connector 1 and the plate P are fixed together.

As shown in FIG. 6, when the position of the plate connector 1 is fixed with respect to the plate P, the position fixing holes 36A of the retainer 30 align with the attachment holes H of the plate P, and the plate attachment members 23A, protruding from each of the position fixing holes 36A, engage through the attachment holes H. At this juncture, since there is no misalignment, for reasons described above, the plate attachment members 23A enter smoothly into the attachment holes H. Moreover, there is almost no likelihood of the plate attachment members 23A getting stuck on the inner wall of the attachment holes H. However, even if the plate attachment members 23A do stick on the inner walls, they can move inwards due to the resilient members 22A. This prevents damage to the plate attachment members 23A by the application of excess force. Similarly, the plate attachment members 23B enter the attachment holes H smoothly without any likelihood of damage.

Once the plate attachment members 23A, 23B are inserted into the attachment holes H in the manner described above, the plate attachment members 23A, 23B are fixed firmly to the plate P by soldering (not shown). The attachment of the plate connector 1 to the plate P is thus complete.

After attaching the plate connector 1 to the plate P, corresponding male connectors (not shown) are inserted into the terminal fittings 20A, 20B after passing through the insertion holes 13A, 13B of the housing 10. In this way, the corresponding connectors are connected to the plate P.

Figure 11:
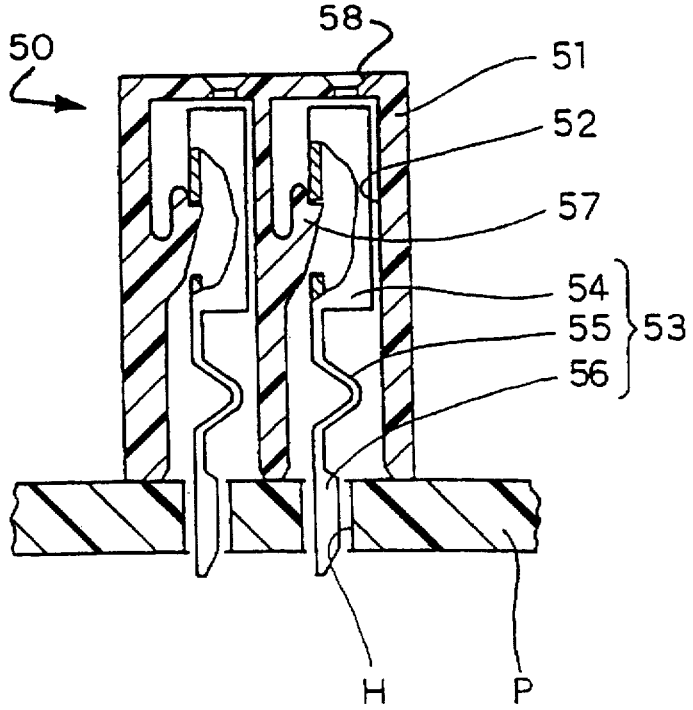
FIG. 11 PRIOR ART
FIG. 11 is a cross-section view showing a prior art plate connector attached to a plate.

Although force is applied towards the plate P due to insertion resistance of the male terminal fittings against the terminal fittings 20A, 20B, the insertion members 21A, 21B are prevented from moving towards the plate attachment members 23A, 23B since the faces 25A, 25B make contact with the pushing faces 32A, 32B. As a result, no force is applied to the plate attachment members 23A, 23B. Furthermore, since the terminal fittings 20A, 20B are supported by means of the abutment of the faces 25A, 25B and the pushing faces 32A, 32B, it is no longer necessary to provide a lance within the cavities 11A, 11B that engages the terminal fittings 20A, 20B (see lance 57 of FIG. 11). Moreover, even if the insertion members 21A, 21B move a little due to tolerance differences, the shoulders 26A, 26B of the resilient members 22A, 22B are engaged by the abutments 38A, 38B, thereby causing the resilient members 22A, 22B to bend and thus preventing their movement towards the plate attachment members 23A, 23B. The insertion resistance force applied to the insertion members 21A, 21B s thereby absorbed, and accordingly no force is applied on the plate attachment members 23A, 23B. Consequently, defective contact of the plate attachment members 23A, 23B due to movement resulting from application of force is prevented.

As described above, the plate connector 1 of the above embodiment is arranged to correct the misalignment of the plate attachment members 23A, 23B by means of the attachment of the retainer 30, and to hold the plate attachment members 23A, 23B in the correct position until attachment to the plate P is complete. As a result, attachment to the plate P can be carried out smoothly and damage to the plate attachment members 23A, 23B due to collision with the plate P can be prevented. Moreover, since the correction of the misalignment of the plate attachment members 23A, 23B is carried out at the same time as the attachment of the retainer 30, operating efficiency is relatively higher compared to a process whereby misalignment is corrected by a process separate from the attachment to the retainer 30.

Moreover, since the retainer 30 has the pushing faces 32A, 32B provided therein, it is no longer necessary to provide elastic fitting members (such as lances) in the cavities 11A, 11B in order to retain the terminal fittings 20A, 20B. Consequently, when the terminal fittings 20A, 20B are inserted into the cavities 11A, 11B, there is no insertion resistance, unlike the case where elastic fitting members are provided. This allows smooth insertion of the terminal fittings 20A, 20B without causing any change in shape or misalignment thereof. Since the shape of the cavities 11A, 11B is relatively simple compared to the case where elastic fitting members are provided, the shape of the mould is simplified and the number of partitions in the mould can be reduced. This permits a lowering of the moulding cost.

Figure 10B:
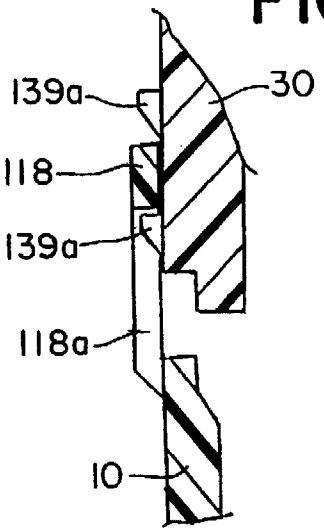
FIG. 10*b* is a scrap section illustrating the intermediate attachment condition.
Figure 10C:
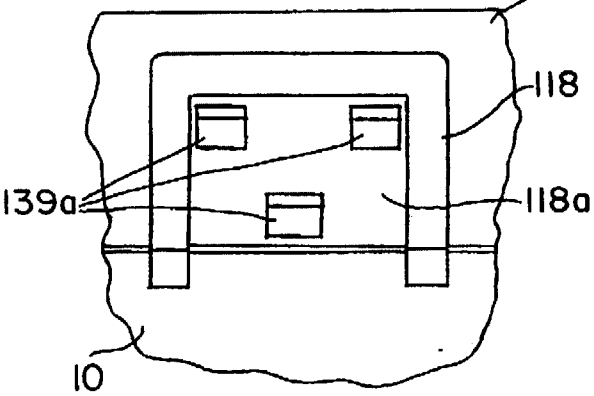
FIG. 10*c* is a scrap elevation illustrating the intermediate attachment condition.
Figure 10A:
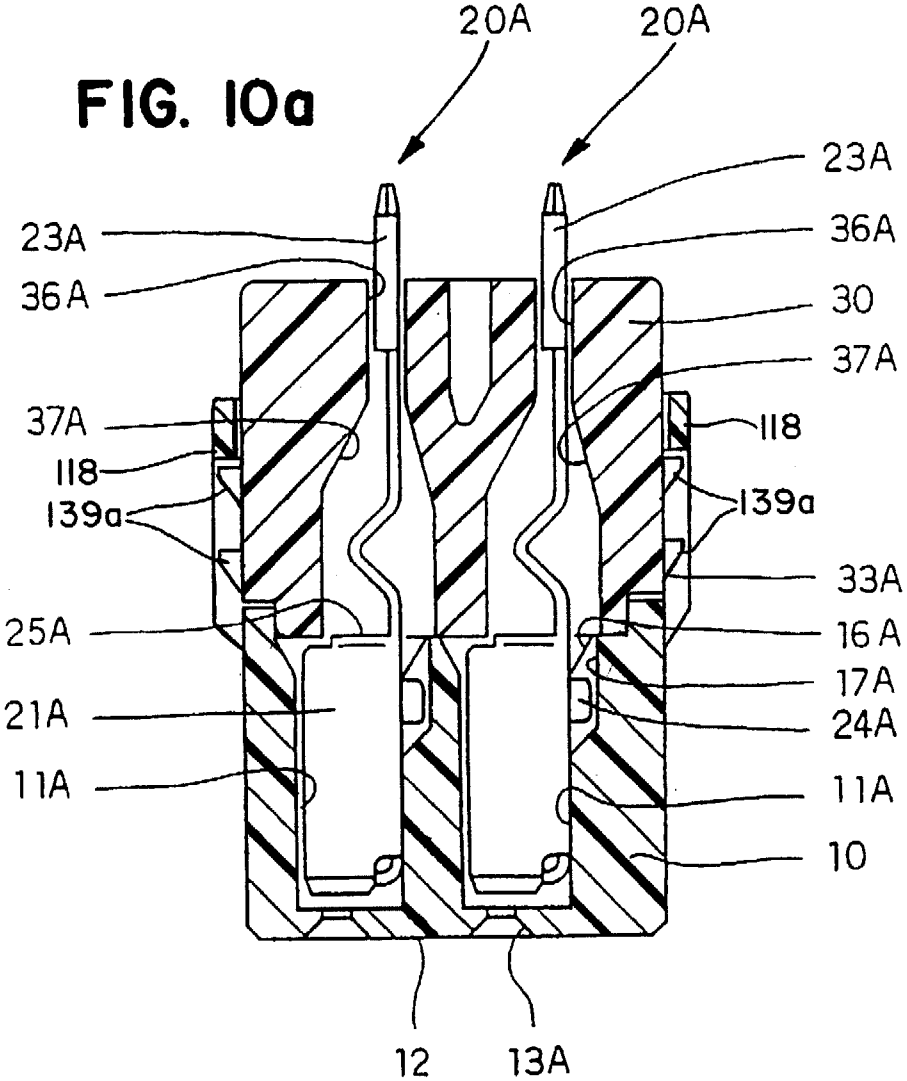
FIG. 10*a* corresponds to FIG. 5 and illustrates a second embodiment having an intermediate attachment condition.

FIGS. 10*a*–10*b* illustrate a second embodiment having an intermediate and final attachment condition.

FIG. 10*a* corresponds to FIG. 5 and the same components are given identical reference numerals.

Alternative resilient plate-shaped fitting members 118 are provided having a larger aperture 118*a* than that illustrated in FIG. 5. The retainer 30 has fitting protrusions 139*a* provided at different levels as illustrated in FIG. 10*c*, two at an inner location and one at an outer location.

In use assembly of the retainer 30 and housing 10 is in the manner previously described with the protrusions 139*a* engaging the aperture 118*a* in a snap fitting manner. However in this embodiment engagement is in two stages. The intermediate stage is illustrated in FIG. 10*b* wherein the protrusions 139*a* lie on either side of the outer arm of the fitting member 118. In this condition the retainer 30 is held securely at a spacing from the housing 10 and thus shields the attachment members 23A from damage during transport thereof, for example by bending.

When desired the retainer can be moved to the final attachment condition, illustrated in FIGS. 10*a* and 10*c*, thus permitting the attachment members 23A to protrude for attachment to the plate P.

By virtue of the position fixing pin 42 and the screwed holes 19*a*, the retainer may be aligned with a plate P and urged to the final attachment condition as the attachment members are engaged in respective position fixing holes 36A.

The angle of the tapered face of the protrusions 139*a* may be arranged to ensure low force engagement in the intermediate condition and relatively high force engagement in the final condition.

The present invention is not limited to the embodiments described above. For example, the possibilities described below also lie within the technical range of the present invention. Moreover, the present invention may be embodied in various ways other than those described below without deviating from the scope thereof.

Although the above embodiments are described with the plate connector 1 having female terminal fittings 20A, 20B provided therein, the present invention can also apply to a plate connector provided with male terminal fittings.

In the embodiments described above, the pushing faces 32A, 32B are provided in the retainer 30 instead of elastic fitting members as a means for holding the terminal fittings 20A, 20B in the fully inserted condition. However, the present invention also applies to plate connectors having elastic fitting members provided in the cavities. In this case too, pushing faces can be provided in the retainer 30. If the pushing faces are provided, the terminal fittings can be pushed into the fully inserted condition even if they stick at a half-inserted position.

We claim:

1. A plate connector comprising a housing with a cavity defined thereby, and a terminal fitting comprising an insertion member in the cavity, a plate attachment member projecting from the housing and adapted for attachment to a plate, and a resilient member inwardly of the plate attachment member;

the plate connector further comprising a retainer attachable to a face of the housing from which said plate attachment member projects, the retainer defining a position fixing hole therein for receiving and correcting the position of the plate attachment member as the retainer is attached to the housing in use;

wherein the retainer includes a tapered guide face for guiding the plate attachment member into the position fixing hole during attachment of the retainer to the housing, and the retainer includes a pushing face for abutment with said insertion member, the pushing face being adapted to urge an insertion member inwardly of said cavity as the retainer is attached to the housing in use.

2. A connector according to claim 1, wherein said tapered guide face is circular about said hole.

3. A connector according to claim 2, wherein said tapered guide face defines said position fixing hole.

4. A connector according to claim 3, wherein said position fixing hole comprising a parallel sided bore outboard of said tapered guide face.

5. A connector according to claim 1 wherein said terminal fitting includes opposite shoulders for abutment with opposite pushing faces of said retainer.

6. A connector according to claim 5, and further including a recess at one side of said cavity, said terminal fitting including a protrusion extending to one side thereof and engageable in said recess on insertion of said fitting.

7. A connector according to claim 5, wherein said protrusion comprises a planar rectangular member substantially perpendicular to said fitting, and the recess comprises a slot.

8. A connector according to claim 1, and further including a recess at one side of said cavity, said terminal fitting including a protrusion extending to one side thereof and engageable in said recess on insertion of said fitting.

9. A connector according to claim 8, wherein said protrusion comprises a planar rectangular member substantially perpendicular to said fitting, and the recess comprises a slot.

10. A connector according to claim 1, wherein said terminal fitting is one piece and comprises said plate attachment member at one end, a connector portion at the other end and adapted to receive an electrical connector, and a mid portion comprising said resilient member.

11. A connector according to claim 10, wherein said resilient member is of serpentine form.

12. A connector according to claim 11, wherein said resilient member extends at one side of said connector portion.

13. A connector according to claim 10, wherein said terminal fitting is formed from a sheet metal.

14. A connector according to claim 1, and having a plurality of said cavities, one of said attachment members being provided for each cavity, and the retainer having a plurality of said position fixing holes, one for each of said attachment members.

15. A connector according to claim 1 wherein said housing and retainer include co-operating snap fitting latch members to retain the housing and retainer in a fully engaged condition.

16. A connector assembly according to claim 15 wherein said housing and retainer further include snap fitting latch members engageable to retain said housing and retainer at a separation.

* * * * *